US010945568B1

(12) United States Patent
Chase

(10) Patent No.: US 10,945,568 B1
(45) Date of Patent: Mar. 16, 2021

(54) RUBBING ALCOHOL DISPENSER APPARATUS

(71) Applicant: Lianne Chase, Stow, MA (US)

(72) Inventor: Lianne Chase, Stow, MA (US)

( * ) Notice: Subject to any disclaimer, the term of this patent is extended or adjusted under 35 U.S.C. 154(b) by 0 days.

(21) Appl. No.: 16/573,111

(22) Filed: Sep. 17, 2019

(51) Int. Cl.

| | |
|---|---|
| ***A47K 10/42*** | (2006.01) |
| ***A47K 10/32*** | (2006.01) |
| ***B65H 1/02*** | (2006.01) |
| ***B65H 1/08*** | (2006.01) |

(52) U.S. Cl.
CPC ..... *A47K 10/427* (2013.01); *B65H 1/022* (2013.01); *B65H 1/08* (2013.01); *A47K 2010/3266* (2013.01)

(58) Field of Classification Search
CPC ..... A47K 10/427; A47K 2010/3266; B65H 1/08; B65H 1/022; B65H 1/12; B65D 83/0817; B65D 83/0823; B65D 83/0829; B65D 83/04
USPC ..... 221/59
See application file for complete search history.

(56) References Cited

U.S. PATENT DOCUMENTS

| | | | | |
|---|---|---|---|---|
| 3,938,898 | A | 2/1976 | Reitnecht | |
| 4,799,815 | A | 1/1989 | Barabino | |
| 5,642,913 | A | 7/1997 | Brown | |
| 5,649,642 | A * | 7/1997 | Mabry | B65D 83/087 221/232 |
| 6,050,449 | A * | 4/2000 | Kanj | B65D 83/12 206/39.4 |
| 6,116,426 | A | 9/2000 | Slonim | |
| 6,254,294 | B1 | 7/2001 | Muhar | |
| 6,387,068 | B1 | 5/2002 | Naughton | |
| 6,491,186 | B1 * | 12/2002 | Wiggins | B42F 7/14 206/39.4 |
| 6,588,960 | B1 | 7/2003 | Barwin | |
| 7,449,148 | B2 * | 11/2008 | Matsumoto | G01D 11/24 29/592 |
| 7,582,262 | B2 * | 9/2009 | Funke | G07F 11/045 422/430 |
| 7,935,307 | B2 * | 5/2011 | Angelides | G01N 33/48757 422/82.01 |
| 8,123,423 | B2 | 2/2012 | Houde | |
| 8,202,853 | B2 | 6/2012 | Adkins | |
| 8,490,828 | B2 * | 7/2013 | Kaiser | B65D 83/0817 221/279 |
| 9,052,305 | B2 * | 6/2015 | Newman | G01N 33/48757 |
| 9,932,166 | B2 * | 4/2018 | Marqua | G07F 11/44 |
| 10,071,846 | B2 * | 9/2018 | Yao | B65D 83/0829 |
| 10,259,640 | B2 * | 4/2019 | Yao | B65D 83/0817 |

(Continued)

*Primary Examiner* — Rakesh Kumar

(57) ABSTRACT

A rubbing alcohol dispenser apparatus for applying rubbing alcohol includes a casing having a casing dispense aperture and a thumb slot extending through to a casing inside. A cartridge housing has a housing dispense aperture and a pin slot extending through to a cartridge inside. The cartridge housing is slidably engageable within the casing inside. A dispense plunger and a lift plunger are coupled within the cartridge inside to manipulate a plurality of alcohol pads through a plurality of pad tracks towards the housing dispense aperture. The dispense plunger has a thumb pin extending through the pin slot and accessible through the thumb slot to reset the dispense plunger and allow the lift plunger to advance the plurality of alcohol pads. The housing dispense aperture aligns with the casing dispense aperture to release rubbing alcohol as needed.

7 Claims, 7 Drawing Sheets

(56) References Cited

U.S. PATENT DOCUMENTS

| | | | | |
|---|---|---|---|---|
| 10,656,112 | B2 * | 5/2020 | Reynolds | G01N 27/3273 |
| 2003/0116583 | A1 * | 6/2003 | Pugh | G01N 33/48757 221/268 |
| 2005/0000979 | A1 * | 1/2005 | Loshkajian | A47F 5/0884 221/282 |
| 2007/0034640 | A1 * | 2/2007 | Casale | B43M 15/00 221/232 |
| 2007/0125794 | A1 * | 6/2007 | Jones | G07F 11/14 221/231 |
| 2008/0094804 | A1 * | 4/2008 | Reynolds | A61B 5/150022 361/727 |
| 2008/0164280 | A1 * | 7/2008 | Kuriger | G01N 33/48757 221/135 |
| 2008/0181818 | A1 * | 7/2008 | Ruan | G01N 33/48757 422/68.1 |
| 2008/0217353 | A1 * | 9/2008 | Newman | G01N 33/48757 221/210 |
| 2008/0217354 | A1 * | 9/2008 | Newman | G01N 33/48757 221/229 |
| 2009/0277923 | A1 * | 11/2009 | Funke | G01N 33/48757 221/154 |
| 2013/0206786 | A1 * | 8/2013 | Diamond | B65D 83/0409 221/24 |
| 2013/0324822 | A1 * | 12/2013 | Prais | A61B 5/1519 600/365 |
| 2014/0086796 | A1 * | 3/2014 | Giraud | G01N 35/00029 422/68.1 |
| 2015/0160186 | A1 * | 6/2015 | Garner-Richards | A61B 5/150564 221/270 |
| 2018/0348160 | A1 * | 12/2018 | Reynolds | G01N 27/3272 |
| 2019/0265226 | A1 * | 8/2019 | Prais | G01N 33/66 |

* cited by examiner

RUBBING ALCOHOL DISPENSER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to antiseptic devices and more particularly pertains to a new antiseptic device for applying rubbing alcohol.

(2) Description of Related Art Including Information Disclosed Under 37 CFR 1.97 and 1.98

The prior art relates to antiseptic devices.

BRIEF SUMMARY OF THE INVENTION

An embodiment of the disclosure meets the needs presented above by generally comprising a casing having a casing front side separated from a casing back side, a casing left side separated from a casing right side, and a casing top side separated from an open casing bottom side defining a casing inside. The casing front side has a casing dispense aperture extending through to the casing inside. The casing left side has a thumb slot extending through to the casing inside from proximal the casing front side to proximal the casing back side aligned with the casing dispense aperture. A cartridge housing has a housing front side separated from a housing back side, a housing left side from a housing right side, and a housing top side separated from a housing bottom side defining a housing inside. The housing back side has a spring protrusion and the housing front side has a housing dispense aperture extending through to the housing inside opposite the spring protrusion. The housing left side has a pin slot extending through to the housing inside from proximal the housing front side to proximal the housing back side between the housing dispense aperture and the spring protrusion. The cartridge housing is slidably engageable within the casing inside through the casing bottom side. The housing dispense aperture and the pin slot align with the casing dispense aperture and the thumb slot, respectively. A dispense plunger is coupled to the cartridge housing. The dispense plunger has a dispense spring coupled within the spring protrusion and a dispense plate coupled to the dispense spring. The dispense plate has a thumb pin extending through the pin slot. A lift plunger is coupled to the cartridge housing. The lift plunger has at least one lift spring coupled to the housing bottom side and a lift plate coupled to the lift spring. A plurality of pad tracks is coupled within the cartridge housing parallel to the lift plate. A plurality of alcohol pads is disposed in rows between the plurality of pad tracks.

An alternative embodiment of the invention comprises a cylindrical casing having a casing front side separated from an open casing back side and a casing sidewall extending therebetween. The casing front side has a casing dispense aperture extending therethrough. A cylindrical cartridge housing has an open housing front side separated from a housing back side and a housing sidewall extending therebetween. The cartridge housing is slidably engageable within the casing through the casing back side. A dispense plunger is coupled to casing. The dispense plunger has a dispense spring coupled to the housing back side and a dispense plate coupled to the dispense spring. A plurality of alcohol pads is disposed in a stack within the cartridge housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
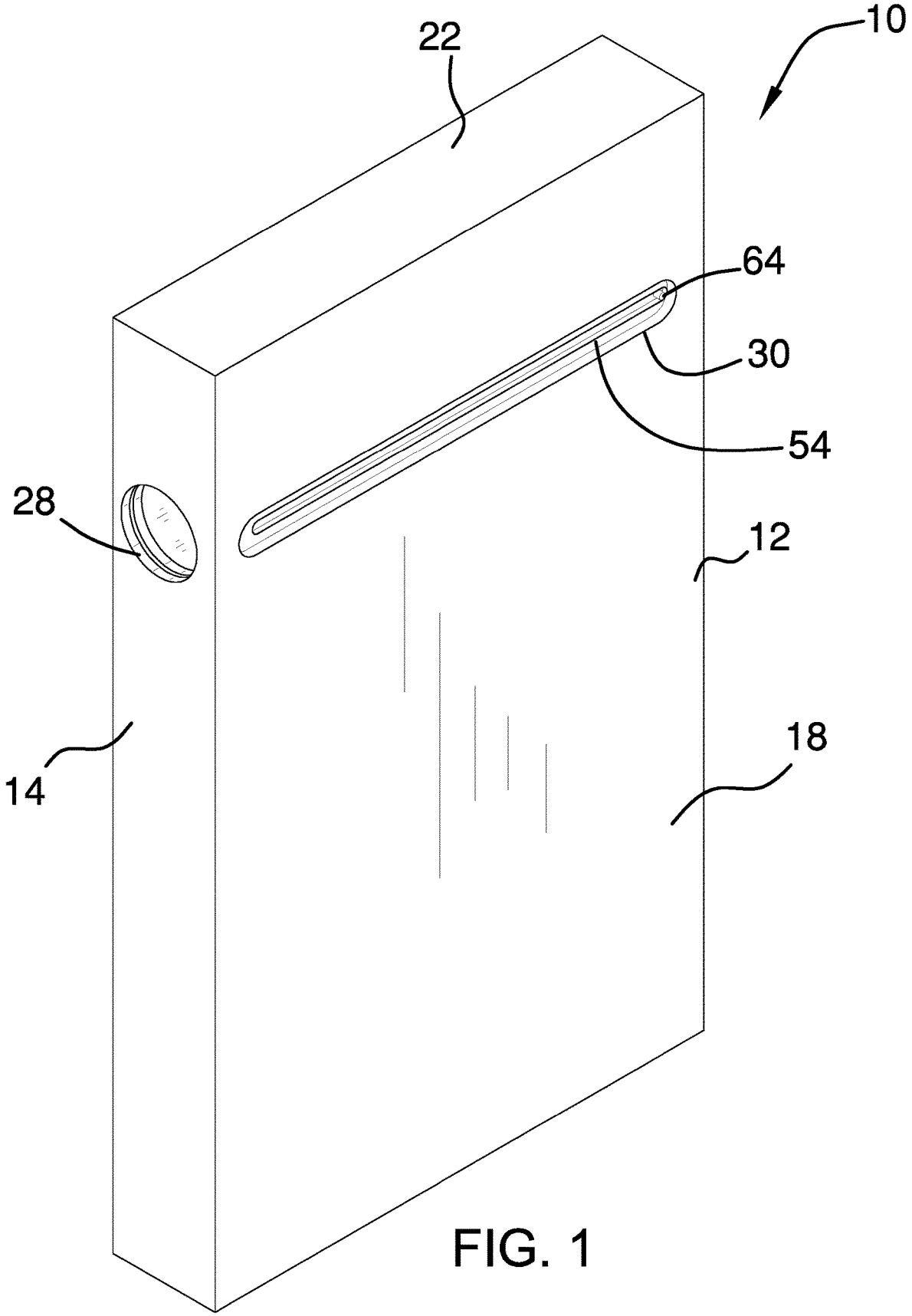
FIG. 1 is an isometric view of a rubbing alcohol dispenser apparatus according to an embodiment of the disclosure.
Figure 2:
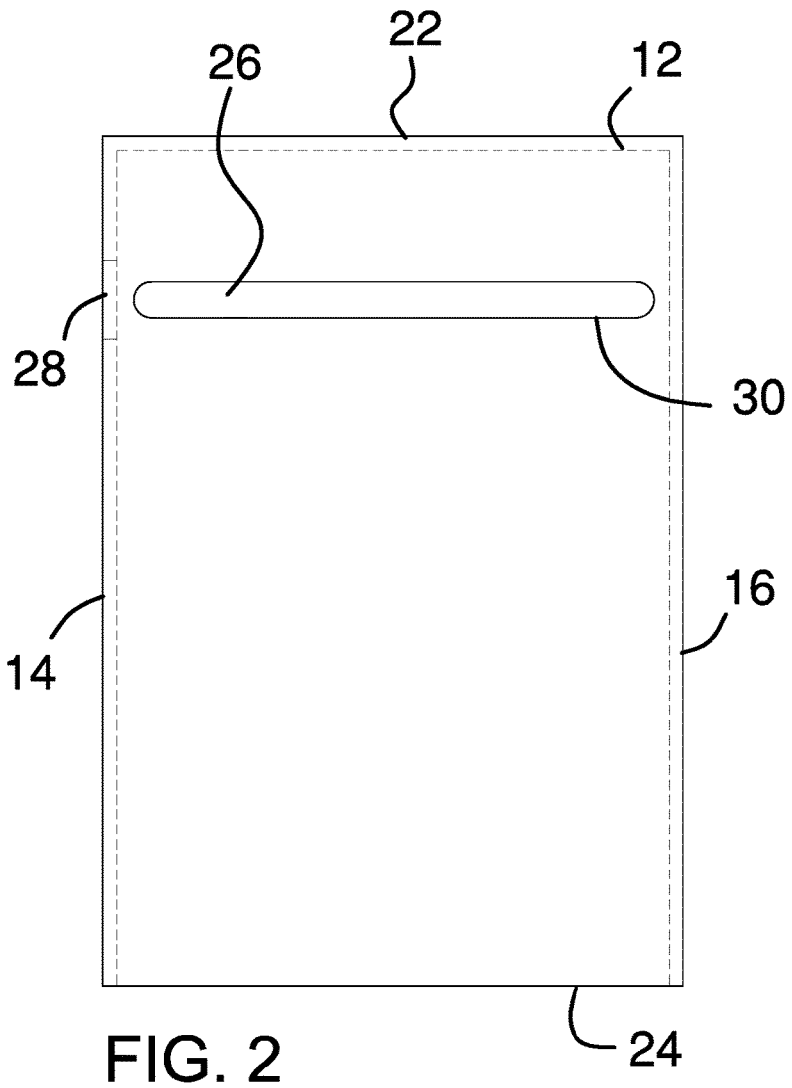
FIG. 2 is a front elevation view of an embodiment of the disclosure.
Figure 4:
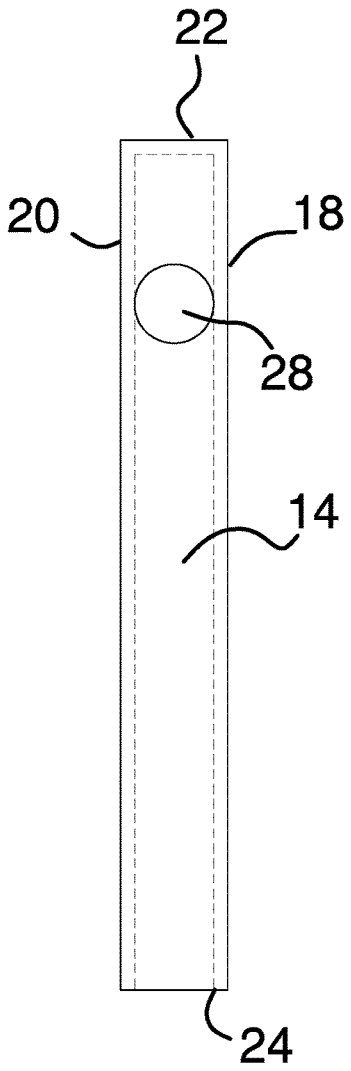
FIG. 4 is a side elevation view of an embodiment of the disclosure.
Figure 3:
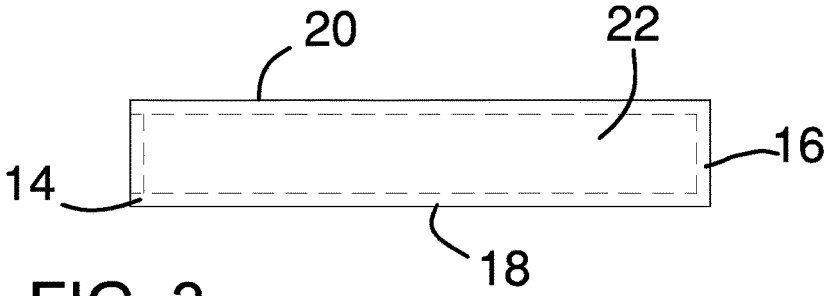
FIG. 3 is a top plan view of an embodiment of the disclosure.
Figure 5:
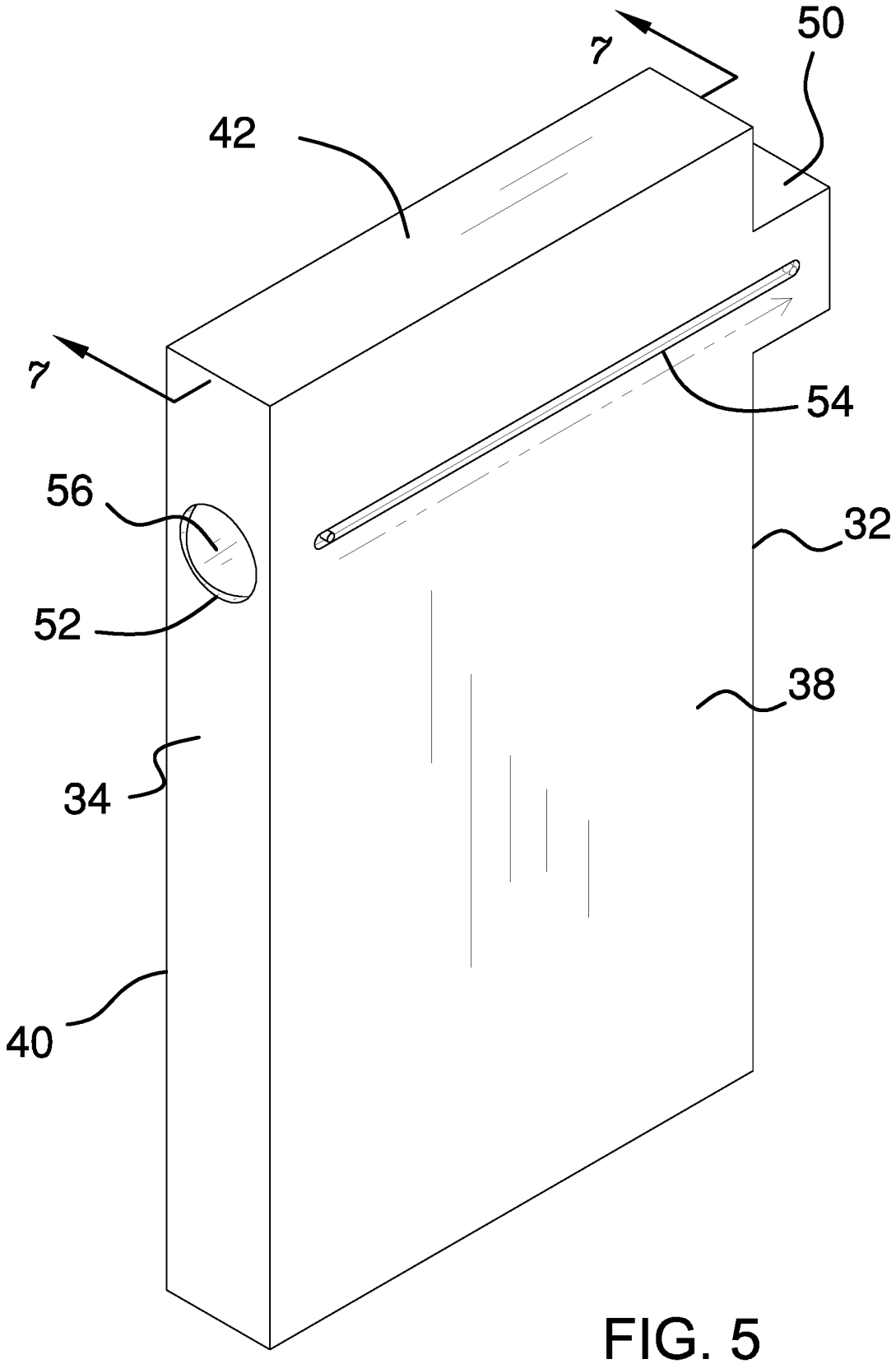
FIG. 5 is an isometric view of an embodiment of the disclosure.
Figure 6:
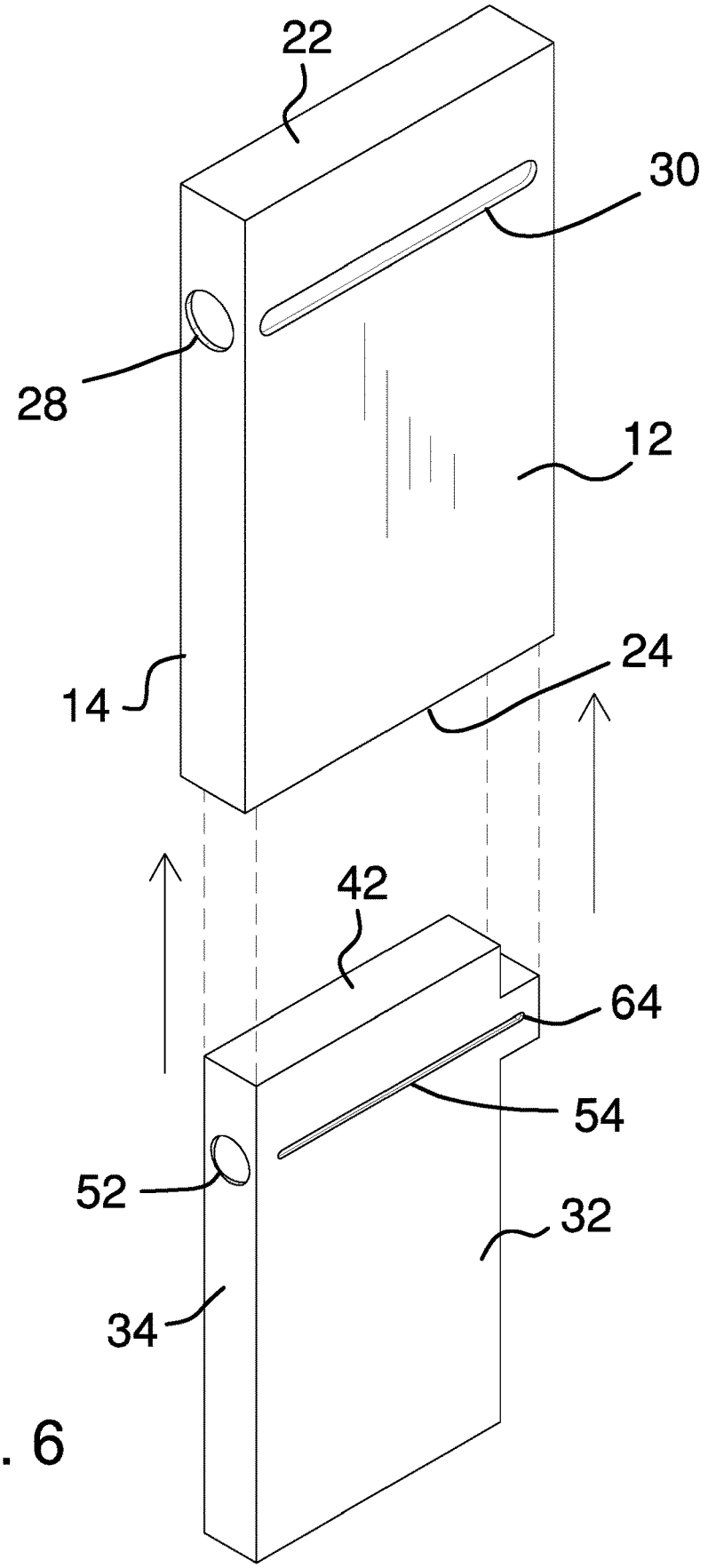
FIG. 6 is an exploded view of an embodiment of the disclosure.
Figure 7:
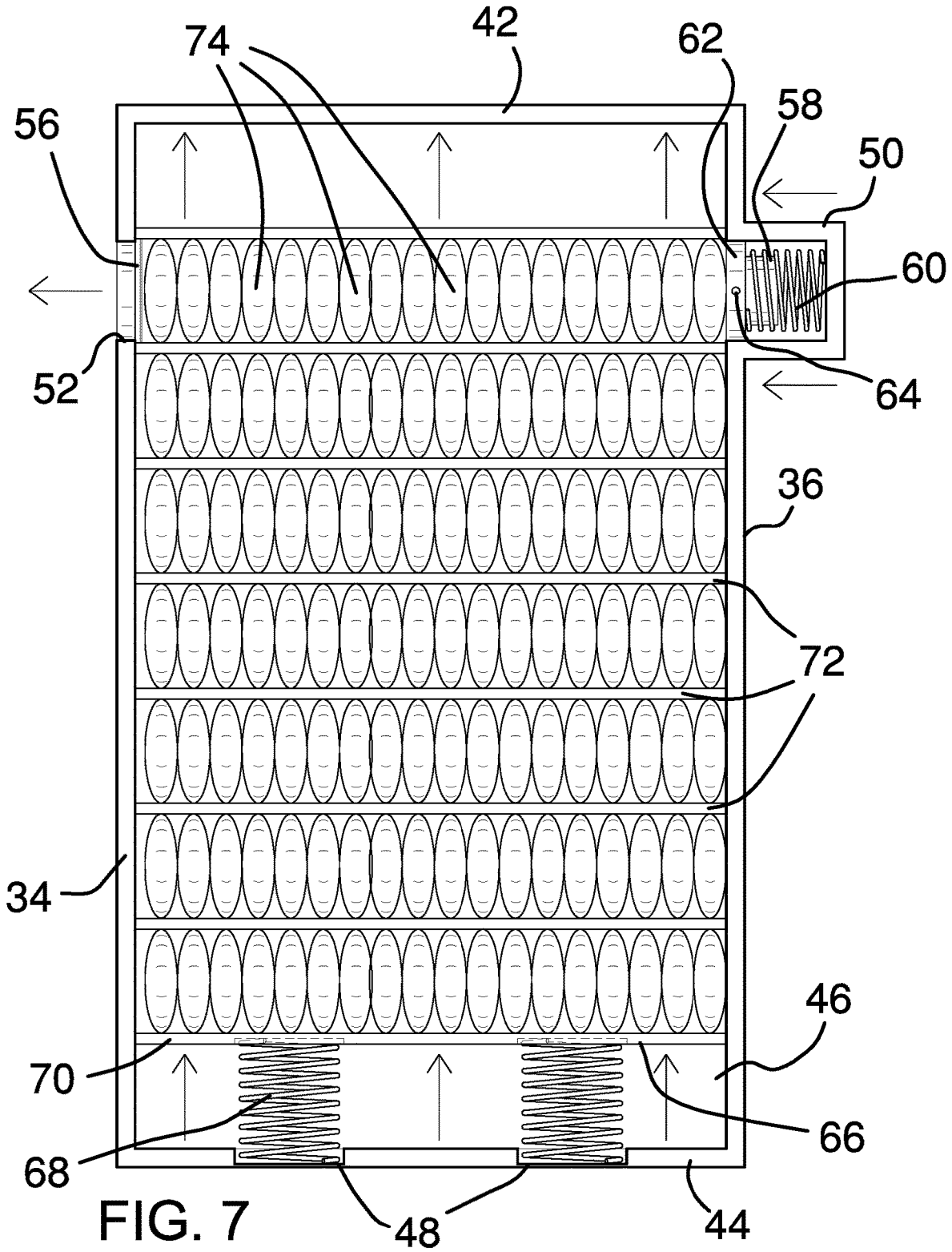
FIG. 7 is a cross-sectional view along the line 7-7 of FIG. 5 of an embodiment of the disclosure.
Figure 8:
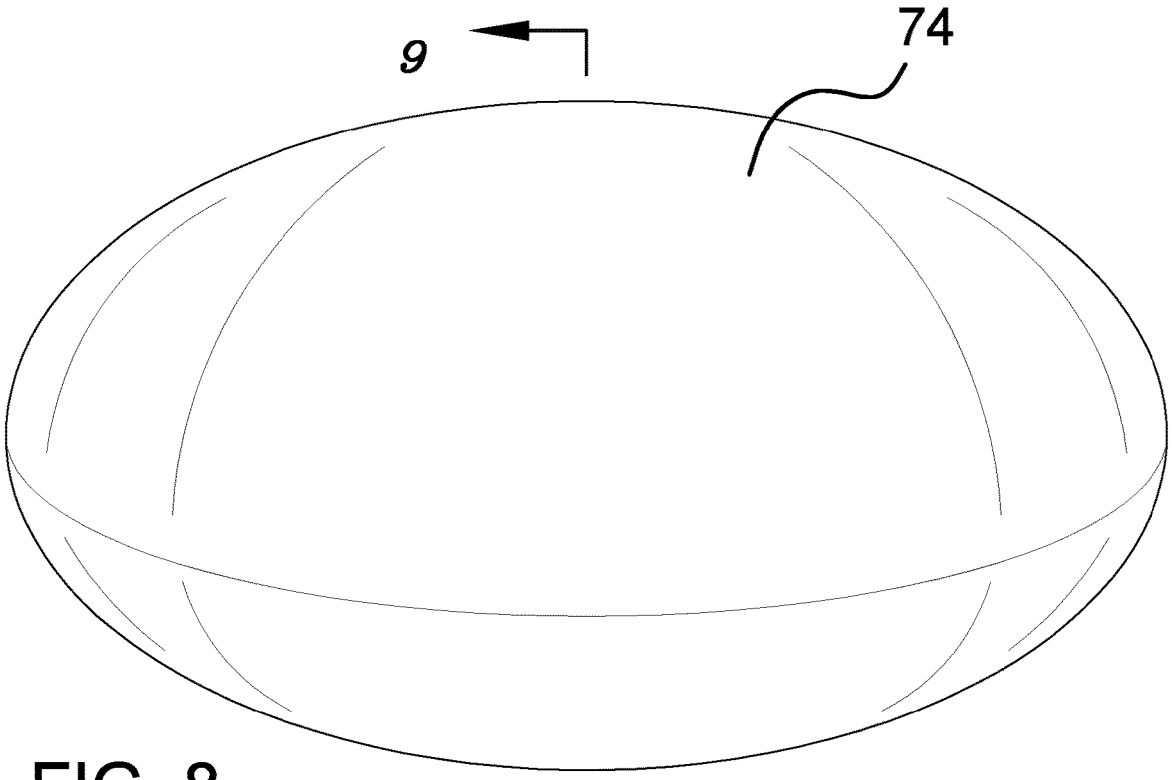
FIG. 8 is an isometric view of an embodiment of the disclosure.
Figure 9:
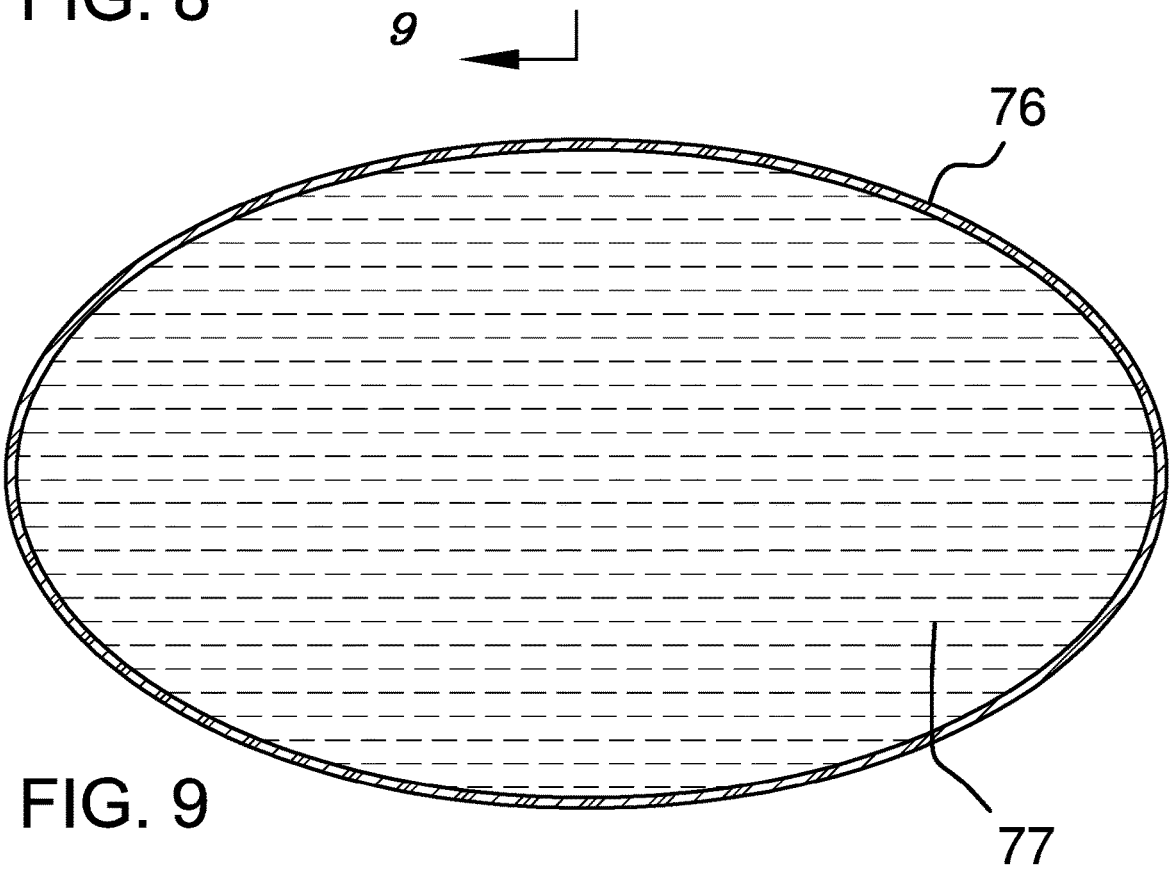
FIG. 9 is a cross-sectional view along the line 9-9 of FIG. 8 of an embodiment of the disclosure.
Figure 10:
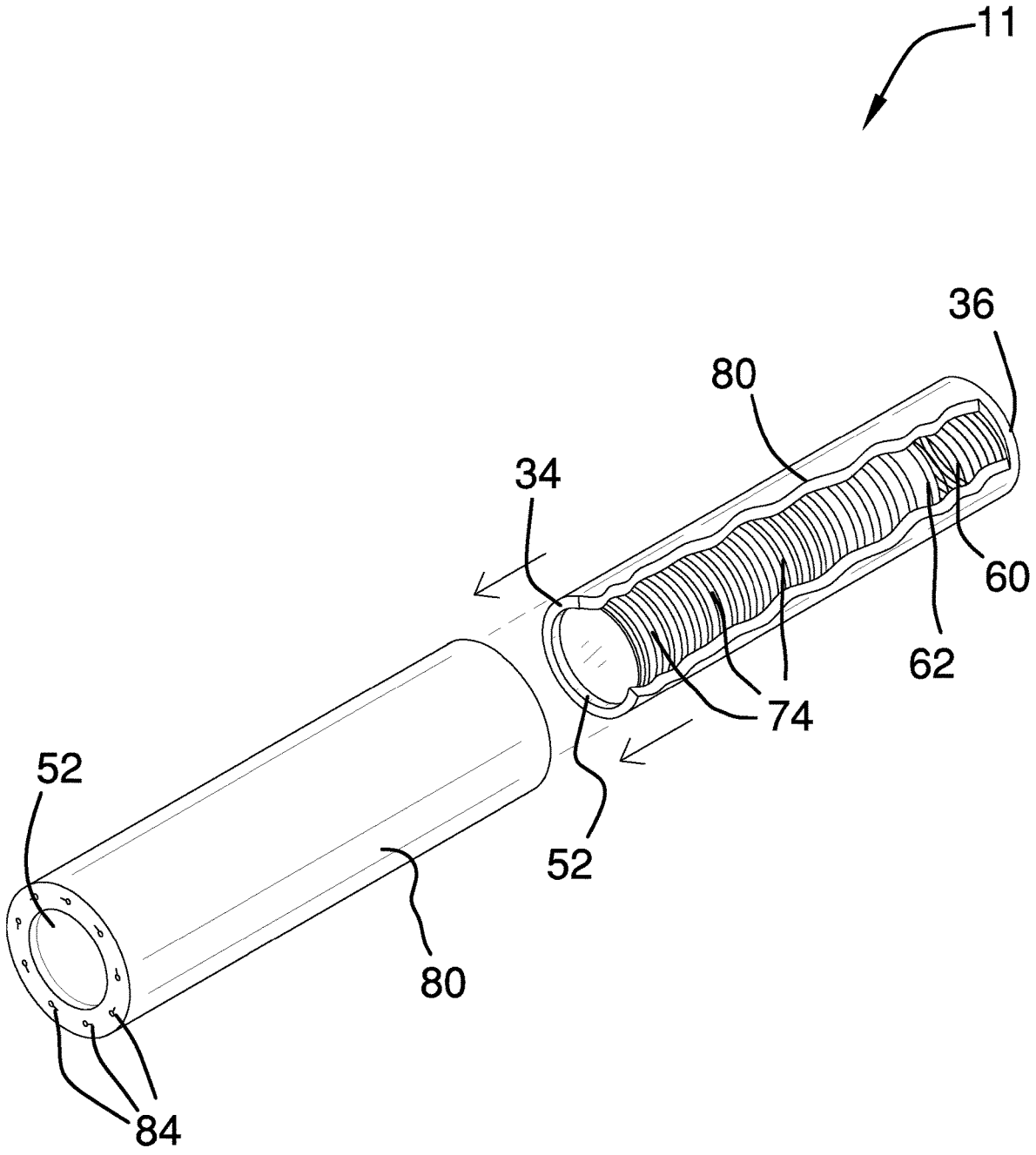
FIG. 10 is an isometric view of an embodiment of the disclosure.

With reference now to the drawings, and in particular to FIGS. 1 through 10 thereof, a new antiseptic device embodying the principles and concepts of an embodiment of the disclosure and generally designated by the reference numeral 10 will be described.

As best illustrated in FIGS. 1 through 10, the rubbing alcohol dispenser apparatus 10 generally comprises a casing 12 having a casing front side 14 separated from a casing back side 16, a casing left side 18 separated from a casing right side 20, and a casing top side 22 separated from an open casing bottom side 24 defining a casing inside 26. The casing front side 14 has a casing dispense aperture 28 extending through to the casing inside 26. The casing left side 18 has a thumb slot 30 extending through to the casing inside 26 from proximal the casing front side 14 to proximal the casing back side 16 aligned with the casing dispense aperture 28.

A cartridge housing 32 has a housing front side 34 separated from a housing back side 36, a housing left side 38 from a housing right side 40, and a housing top side 42 separated from a housing bottom side 44 defining a housing inside 46. The housing bottom side 44 has a pair of spring notches 48. The housing back side 36 has a spring protrusion 50 and the housing front side 34 has a housing dispense aperture 52 extending through to the housing inside 46 opposite the spring protrusion 50. The housing left side 38 has a pin slot 54 extending through to the housing inside 46 from proximal the housing front side 34 to proximal the housing back side 36 between the housing dispense aperture 52 and the spring protrusion 50. A width of the thumb slot 30 is greater than a width of the pin slot 54. The cartridge housing 32 is slidably engageable within the casing inside 26 through the casing bottom side 24.

The housing dispense aperture 52 and the pin slot 54 align with the casing dispense aperture 28 and the thumb slot 30, respectively. A seal 56 is coupled to the housing front side 34 over the housing dispense aperture 52. A dispense plunger 58 is coupled to the cartridge housing 32. The dispense plunger 58 has a dispense spring 60 coupled within the spring protrusion 50 and a dispense plate 62 coupled to the dispense spring 60. The dispense plate 62 has a thumb pin 64 extending through the pin slot 54. A lift plunger 66 is coupled to the cartridge housing 32. The lift plunger 66 has at least one lift spring 68 coupled to the housing bottom side 44 and a lift plate 70 coupled to the lift spring 68. The lift spring 68 is two lift springs 68 coupled within the pair of spring notches 48. A plurality of pad tracks 72 is coupled within the cartridge housing 32 parallel to the lift plate 70. A plurality of alcohol pads 74 is disposed in rows between the plurality of pad tracks 72. Each alcohol pad 74 has an ellipsoidal outer skin 76 and an alcohol filling 77 within the outer skin 76. The outer skin 76 is elastomeric.

In an alternative embodiment of the invention 11, the casing 12 is cylindrical and has the casing front side 14 separated from the casing back side 16 and a casing sidewall 78 extending therebetween. The casing front side 14 has the casing dispense aperture 28 extending therethrough. The casing back side 16 is open to receive the cartridge housing 32. The cartridge housing 32 is cylindrical and the housing front side 34 is open and separated from the housing back side 36 and a housing sidewall 80 extending therebetween. The cartridge housing 32 is slidably engageable within the casing 12 through the casing back side 16. The dispense plunger 58 is coupled to the casing 12. The dispense plunger 58 has the dispense spring 60 coupled to the housing back side 36 and the dispense plate 62 coupled to the dispense spring 60. The plurality of alcohol pads 74 is disposed in a stack within the cartridge housing 32. There may be a plurality of dispersal holes 84 extending through the casing front side 14 around the casing dispense aperture 28.

In use, the user inserts the cartridge housing 32 into the casing 12. The thumb pin 64 is manipulated through the thumb slot 30 and the pin slot 54 to move the dispense plunger 58 and to eject the alcohol pads 74 through the housing dispense aperture 52 and the casing dispense aperture 28 to apply rubbing alcohol to sanitize a target area. yy With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rubbing alcohol dispenser apparatus comprising:

a casing having a casing front side separated from a casing back side, a casing left side separated from a casing right side, and a casing top side separated from an open casing bottom side defining a casing inside, the casing front side having a casing dispense aperture extending through to the casing inside, the casing left side having a thumb slot extending through to the casing inside from proximal the casing front side to proximal the casing back side aligned with the casing dispense aperture;

a cartridge housing having a housing front side separated from a housing back side, a housing left side separated from a housing right side, and a housing top side separated from a housing bottom side defining a housing inside, the housing back side having a spring protrusion and the housing front side having a housing dispense aperture extending through to the housing inside opposite the spring protrusion, the housing left side having a pin slot extending through to the housing inside from proximal the housing front side to proximal the housing back side between the housing dispense aperture and the spring protrusion, the cartridge housing being slidably engageable within the casing inside through the casing bottom side, the housing dispense aperture and the pin slot aligning with the casing dispense aperture and the thumb slot, respectively;

a dispense plunger coupled to the cartridge housing, the dispense plunger having a dispense spring coupled within the spring protrusion and a dispense plate coupled to the dispense spring, the dispense plate having a thumb pin extending through the pin slot;

a lift plunger coupled to the cartridge housing, the lift plunger having at least one lift spring coupled to the housing bottom side and a lift plate coupled to the lift spring;

a plurality of pad tracks coupled to the cartridge housing, the plurality of pad tracks being coupled within the cartridge housing parallel to the lift plate; and a plurality of alcohol pads, the alcohol pads being disposed in rows between the plurality of pad tracks.

2. The rubbing alcohol dispenser apparatus of claim 1 further comprising each alcohol pad having an ellipsoidal outer skin and an alcohol filling within the outer skin.

3. The rubbing alcohol dispenser apparatus of claim 1 further comprising the outer skin being elastomeric.

4. The rubbing alcohol dispenser apparatus of claim 1 further comprising a seal coupled to the cartridge housing, the seal being coupled to the housing front side over the housing dispense aperture.

5. The rubbing alcohol dispenser apparatus of claim 1 further comprising the housing bottom side having a pair of spring notches, the lift spring being two lift springs coupled within the pair of spring notches.

6. The rubbing alcohol dispenser apparatus of claim 1 further comprising a width of the thumb slot being greater than a width of the pin slot.

7. A rubbing alcohol dispenser apparatus comprising:

a casing having a casing front side separated from a casing back side, a casing left side separated from a casing right side, and a casing top side separated from an open casing bottom side defining a casing inside, the casing front side having a casing dispense aperture extending through to the casing inside, the casing left side having a thumb slot extending through to the casing inside from proximal the casing front side to proximal the casing back side aligned with the casing dispense aperture;

a cartridge housing having a housing front side separated from a housing back side, a housing left side separated from a housing right side, and a housing top side separated from a housing bottom side defining a housing inside, the housing bottom side having a pair of spring notches, the housing back side having a spring protrusion and the housing front side having a housing dispense aperture extending through to the housing inside opposite the spring protrusion, the housing left side having a pin slot extending through to the housing inside from proximal the housing front side to proximal the housing back side between the housing dispense aperture and the spring protrusion, a width of the thumb slot being greater than a width of the pin slot, the cartridge housing being slidably engageable within the casing inside through the casing bottom side, the housing dispense aperture and the pin slot aligning with the casing dispense aperture and the thumb slot, respectively;

a seal coupled to the cartridge housing, the seal being coupled to the housing front side over the housing dispense aperture;

a dispense plunger coupled to the cartridge housing, the dispense plunger having a dispense spring coupled within the spring protrusion and a dispense plate coupled to the dispense spring, the dispense plate having a thumb pin extending through the pin slot;

a lift plunger coupled to the cartridge housing, the lift plunger having at least one lift spring coupled to the housing bottom side and a lift plate coupled to the lift spring, the lift spring being two lift springs coupled within the pair of spring notches;

a plurality of pad tracks coupled to the cartridge housing, the plurality of pad tracks being coupled within the cartridge housing parallel to the lift plate; and a plurality of alcohol pads, the alcohol pads being disposed in rows between the plurality of pad tracks, each alcohol pad having an ellipsoidal outer skin and an alcohol filling within the outer skin, the outer skin being elastomeric.

* * * * *